US011583046B2

(12) United States Patent
Obst

(10) Patent No.: US 11,583,046 B2
(45) Date of Patent: Feb. 21, 2023

(54) MODULAR UTILITY KIT

(71) Applicant: James B. Obst, Stephenson, VA (US)

(72) Inventor: James B. Obst, Stephenson, VA (US)

( * ) Notice: Subject to any disclaimer, the term of this patent is extended or adjusted under 35 U.S.C. 154(b) by 377 days.

(21) Appl. No.: 16/798,645

(22) Filed: Feb. 24, 2020

(65) Prior Publication Data

US 2021/0000232 A1 Jan. 7, 2021

Related U.S. Application Data

(60) Provisional application No. 62/870,753, filed on Jul. 4, 2019.

(51) Int. Cl.

| | |
|---|---|
| ***A45C 7/00*** | (2006.01) |
| ***A45C 3/00*** | (2006.01) |
| ***A45C 13/02*** | (2006.01) |
| ***B25H 3/00*** | (2006.01) |

(52) U.S. Cl.

CPC ..... *A45C 7/0095* (2013.01); *A45C 3/00* (2013.01); *A45C 7/009* (2013.01); *A45C 13/02* (2013.01); *B25H 3/00* (2013.01)

(58) Field of Classification Search

CPC ..... A45C 7/0095; A45C 3/00; A45C 7/009; A45C 13/02; B25H 3/00

See application file for complete search history.

(56) References Cited

U.S. PATENT DOCUMENTS 185,181 A * 12/1876 Keeny ..... A45C 3/00 190/111
1,085,950 A 2/1914 Steinthal
1,094,009 A 4/1914 Parkhurst
1,171,896 A 2/1916 Simpson
2,118,323 A 5/1938 Murphy
2,679,877 A * 6/1954 Leggett ..... B42F 7/04 383/39
5,052,555 A 10/1991 Harmon
5,337,933 A 8/1994 Nunez
5,427,239 A 6/1995 Hunt
5,653,337 A 8/1997 Cirigliano
5,897,209 A 4/1999 Roegner
6,260,700 B1 7/2001 Huang
6,296,094 B1 * 10/2001 Knecht ..... A45C 7/0095 206/281
7,441,977 B2 * 10/2008 Merzon ..... A45C 13/02 281/31
8,157,068 B2 * 4/2012 Sapyta ..... A45C 13/02 190/110
8,272,505 B2 * 9/2012 Melamed ..... A45C 13/103 190/111

(Continued)

FOREIGN PATENT DOCUMENTS

WO 2016177889 11/2016

*Primary Examiner* — Tri M Mai

(74) *Attorney, Agent, or Firm* — Benjamin C. Rothermel, Esq.

(57) ABSTRACT

The present disclosure relates to a modular utility kit employing a containerized storage system. The modular utility kit includes a core having a first pouch, a second pouch, a third pouch, a fourth pouch, a fifth pouch, and a sixth pouch. The modular utility kit further includes a first shell detachably surrounding the core, a second shell detachably surrounding the first shell and the core, and a third shell detachably surrounding the second shell, the first shell, and the core.

10 Claims, 15 Drawing Sheets

(56) References Cited

U.S. PATENT DOCUMENTS

| | | | | |
|---|---|---|---|---|
| 9,345,298 | B2 * | 5/2016 | Bettua | A45C 5/03 |
| 9,943,956 | B1 | 4/2018 | Giamanco et al. | |
| 10,173,315 | B2 | 1/2019 | Giamanco et al. | |
| 10,251,721 | B2 | 4/2019 | Garratt et al. | |
| 2005/0011774 | A1 * | 1/2005 | Barker | A45C 7/0086<br>206/557 |
| 2006/0070901 | A1 | 4/2006 | Adams et al. | |
| 2006/0207697 | A1 * | 9/2006 | Greiner | A45C 7/0095<br>150/113 |
| 2009/0255936 | A1 | 10/2009 | Rabbit | |
| 2020/0054107 | A1 * | 2/2020 | Rosemarie | A45C 13/03 |
| 2021/0196017 | A1 * | 7/2021 | Goodison | A45C 13/02 |

* cited by examiner

MODULAR UTILITY KIT

CROSS-REFERENCE TO RELATED APPLICATION

This application claims priority from U.S. Provisional Patent Application No. 62/870,753, filed on Jul. 4, 2019, which is hereby incorporated by reference for all purposes as if fully set forth herein.

BACKGROUND

Field

Exemplary embodiments relate to a modular utility kit employing a containerized storage system.

Discussion of the Background

Currently, there are a number of solutions for utility kits including tool kit designs for mechanical repairs, but these solutions often fall short because they may be too generic, too large and/or too heavy. They often are laden with a wide variety of tools in their attempt to meet every mechanical repair need conceivable. Their carrying cases are often constructed in molded plastic, which may not only limit the variety of items they can carry, but may also restrict them to carry only those items designed to fit the carrying case. Another shortfall of other utility kit designs is they may be designed to carry such a wide variety of tools it may be difficult to gain access to specific tools needed without having to remove much of the entire kit's contents.

Current mechanical utility kits may be inadequate in that they may provide nothing beyond an assortment of hand tools. With a focus on having a large assortment of tools, they may completely overlook the need for repair supplies that are essential in completing most mechanical repairs. Yet another deficiency in the current utility kit design is the lack of any type of "Help Book" to guide its user through conventional repairs and the preferred use of repair supplies. Furthermore, they may do nothing to offer any assistance in repair innovation, or how to obtain results from limited repair materials or supplies currently available on-hand.

In military combat, the moment a vehicle malfunction or battle damage is detected, the speed of response and actions taken by operators and/or crews may be critical to the survival of the crews, their unit, and the completion of their mission. To ensure that prompt repairs may be accomplished, the military has developed Battle Damage Assessment and Repair (BDAR) doctrinal procedures. BDAR is a process to rapidly return disabled equipment to operational status employing expedient mechanical field repairs. BDAR restores the minimum essential vehicle capabilities necessary to support a specific combat mission and/or to enable the equipment to self-recover.

BDAR procedures are designed for battlefield environments and are used in situations where standard maintenance procedures are not practical or possible. These procedures are not meant to replace standard maintenance procedures, only to sustain the vehicle and/or equipment until permanent repairs can be accomplished. Often preformed in life threatening situations, BDAR may be accomplished by bypassing components or safety devices, cannibalizing parts from like or lower priority equipment, fabricating repair parts, jury-rigging, taking shortcuts to standard maintenance, and using substitute fluids, materials or components.

In addition to taking full advantage of BDAR procedures, it may also be important that the responding personnel are able to access mechanical repair equipment as expediently and efficiently as possible. In the case of damage sustained in combat in particular, a delay in achieving suitable repair could have fatal results. Time lost attempting to locate a required piece of repair equipment may be critical and could mean the difference between life or death.

A range of repair tools and supplies that enable both the civilian and military personnel to attend to a wide range of vehicle malfunctions and breakdowns may exist. However, the requirement to carry such a wide range of repair equipment, and a typical toolbox layout often randomly places repair items in a layered configuration, and items may be placed only where space allows. This inconsistent arrangement may require that much of the kit's contents must be removed to find the appropriate repair items. The operators and/or crews of these vehicles may be unfamiliar with the contents of the typical repair toolbox/device because these may be assembled by a third party, making the operator's job of selecting the required piece of repair equipment at a critical time difficult.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a modular utility kit having an assemblage of separate containers to accommodate mechanical repair tools and supplies.

Exemplary embodiments also provide a modular utility kit allowing instant identification and access to the entirety of its contents.

Exemplary embodiments also provide a modular utility kit having efficient storage to maximize its payload capacity, which is integrated into a compact portable package.

Additional aspects will be set forth in the detailed description which follows, and, in part, will be apparent from the disclosure, or may be learned by practice of the inventive concept.

According to exemplary embodiments, a modular utility kit includes a core having a first pouch, a second pouch, a third pouch, a fourth pouch, a fifth pouch, and a sixth pouch. The modular utility kit further includes a first shell detachably surrounding the core, a second shell detachably surrounding the first shell and the core, and a third shell detachably surrounding the second shell, the first shell, and the core.

According to exemplary embodiments, a modular utility kit includes an unfoldable core comprising a first pouch, a second pouch, a third pouch, a fourth pouch, a fifth pouch, and a sixth pouch. The modular utility kit further includes a first shell detachably surrounding the core. The first pouch, the second pouch, the third pouch, and the sixth pouch are disposed between the fourth pouch and the fifth pouch, and the first shell, in the core.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
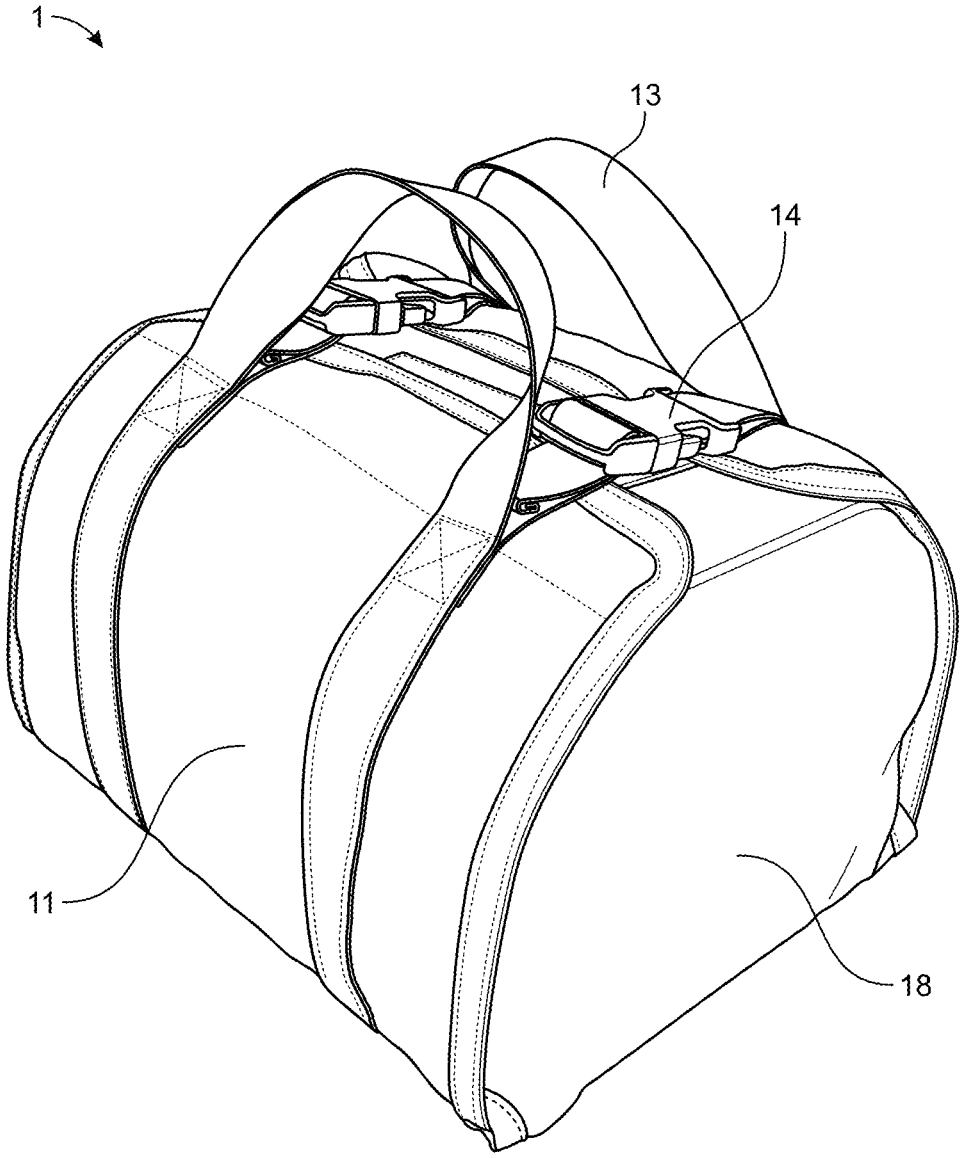
FIG. 1 is a perspective view illustrating a modular utility kit according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Exemplary embodiments of the present inventive concept relate to a modular utility kit employing a containerized storage system. Exemplary embodiments disclose a modular utility kit having an assemblage of separate containers to accommodate mechanical repair tools and supplies. Exemplary embodiments also provide a modular utility kit allowing instant identification and access to the entirety of its contents. Exemplary embodiments also provide a modular utility kit having efficient storage to maximize its payload capacity, which is integrated into a compact portable package.

The modular utility kit according to exemplary embodiments may include a waterproof outer shell including a waterproof zipper to maintain the clean and dry interior. The outer shell may have two carry handles that use a hook and loop fastener to couple the two handles together at the top, with an additional hook and loop strip to permit storing the handles when not in use allowing the handles to affix flat against the outer shell. Adjustable compression straps coupled together with quick release buckles on an upper exterior surface of the outer shell, to maintain the device in a compact shape and size.

Additional internal pockets for flat storage may be on the interior sides of the outer shell. These additional storage pockets are segmented and closed using the hook and loop method. Inside one of these flat pockets may be a "Help Book" that instructs both the conventional and creative repair methods.

The modular utility kit may also include a split inner shell cover with two longitudinally parallel, hook and loop strips to secure the inner shell assembly. The inner shell cover may have an assemblage of fabric pouches to contain the storage container system, with a container to pouch retainer strap of hook and loop material. Once the assembly is un-folded and laid-out the display provides the entirety of the repair kit's contents instantaneously. Furthermore, the system of individual storage containers provides a wide variety of kit adaptability where specific repair containers can easily be swapped for a different repair requirement or type.

The modular utility kit's system of individual storage containers may also include a pair of interior cylindrical pockets, each utilizing a single hook and loop strap closure at the ends of each to provide access from either end of the pocket. These two cylindrical pockets are affixed to the upper most container pouch. The modular utility kit may have a system of "Color Keyed" identification tags attached to each individual compartment pouch to assist in the reassembly of a deployed modular system back into its "stowed" configuration. The modular utility kit may have an additional hook and loop strap to hold the assemblage securely prior to closing the inner shell cover. The modular utility kit may also have interior storage containers with a continuous hinge seam with a flush locking mechanism. The modular utility kit may alternatively have a modular arrangement of storage containers other than the current device's "cube" configuration, where the container assemblage is organized in a rectangular, flat grouping.

The modular utility kit according to exemplary embodiments is compact and portable, easy to stow and to carry. The modular utility kit's modular containerized system that opens-up to instantly display its entire contents makes is the contents easy to get to and easily accessible. Because it is a containerized system, the contents of each container are customizable and designed to provide ample storage space for both tools and repair supplies. Since it is containerized, containers can be distributed and shared amongst a group of technicians tasked with multiple repairs. Additionally, because it is containerized, the modular utility kit is completely adaptable and can be modified to meet the repair needs of a wide variety of vehicle types, for land, sea and air. Moreover, the modular utility kit is designed to provide its own "Help Book" to assist in conventional repairs as well as "innovative" repair concepts.

The modular utility kit according to exemplary embodiments provides stowage space for tools as well as essential repair supplies and hardware that are just as important as hand tools in the completion of effective mechanical repairs. The modular utility kit is designed to provide the resources necessary for expedient mechanical repairs. The modular utility kit, when un-folded and completely opened, exposes its contents, which are immediately identifiable and accessible because of this unique modular design.

The modular utility kit's containerized system allows users to adapt or configure the contents of each individual container to meet any predetermined repair type or need. Moreover, the modular utility kit provides a self-contained "Help Book" that instructs conventional repair methods as well as encourages expanding its repair capabilities through ingenuity to get the most out of the tools and supplies on hand.

The modular utility kit according to exemplary embodiments is superior to other devices because its structure is an arrangement of separately hinged, fabric pouches that provide a method of assembling this device's modular storage system of detachable clear plastic containers. Moreover, this device is structurally unique with its utilization of individual containers as the primary element of its storage system. Furthermore, the method of using the aforementioned device is likewise unique since from its stowed configuration the entire assemblage of pouches and storage containers simply unfolds to instantly display the entire contents of the device. This method of containerized storage offers adaptability and the distribution of individual containers as needs and requirements change. The modular utility kit is superior to other devices because it can be configured in various ways. The modular utility kit may also be configured to hold non-mechanical items such as fishing tackle or even configured as a Medical First Aid Kit. The scope of the device's possible configurations is only limited by one's imagination and need.

Exemplary embodiments provide an improved toolbox/storage system for mechanical repairs, one that places similar repair items together in separate, transparent containers, and a system that provides for instant identification of tools and repair supplies. Exemplary embodiments provide a system for carrying mechanical repair tools and supplies, which addresses the above-described problems and/or which offers improvements thereon.

An exemplary embodiment is directed to a modular utility kit 1 employing a containerized storage system, as shown in FIG. 1, FIG. 2, FIG. 3, FIG. 4, FIG. 5, FIG. 6, FIG. 7, and FIG. 8. The modular utility kit 1 includes a six-sided, cube-like, fabric bag, having an outer shell cover 11 and inner shell cover 18, as shown in FIG. 1. The outer shell cover 11 and the inner shell cover 18 completely surrounds the two longer parallel front and back sides, the two shorter parallel left and right sides, the bottom, and nearly the entire top where the outer shell cover 11 is closed and opened.

Attached in parallel at the top edges of both sides of the outer shell cover 11 is a pair of retaining straps coupled together with a pair of quick-release, adjustable buckles 14 which are configured to securely fasten the outer shell cover 11 closed. The retaining straps include a pair of looped fabric handles 13 affixed in parallel onto the exterior of the outer shell cover 11. The retaining straps encircle the exterior of the outer shell cover 11, and come together and meet at the modular utility kit's 1 upper side. Adjustable compression straps may be attached to the outer shell cover 11 at the upper side of the modular utility kit 1, the compression straps are shown in the present exemplary embodiment as being integrated with the adjustable buckles 14.

Figure 2:
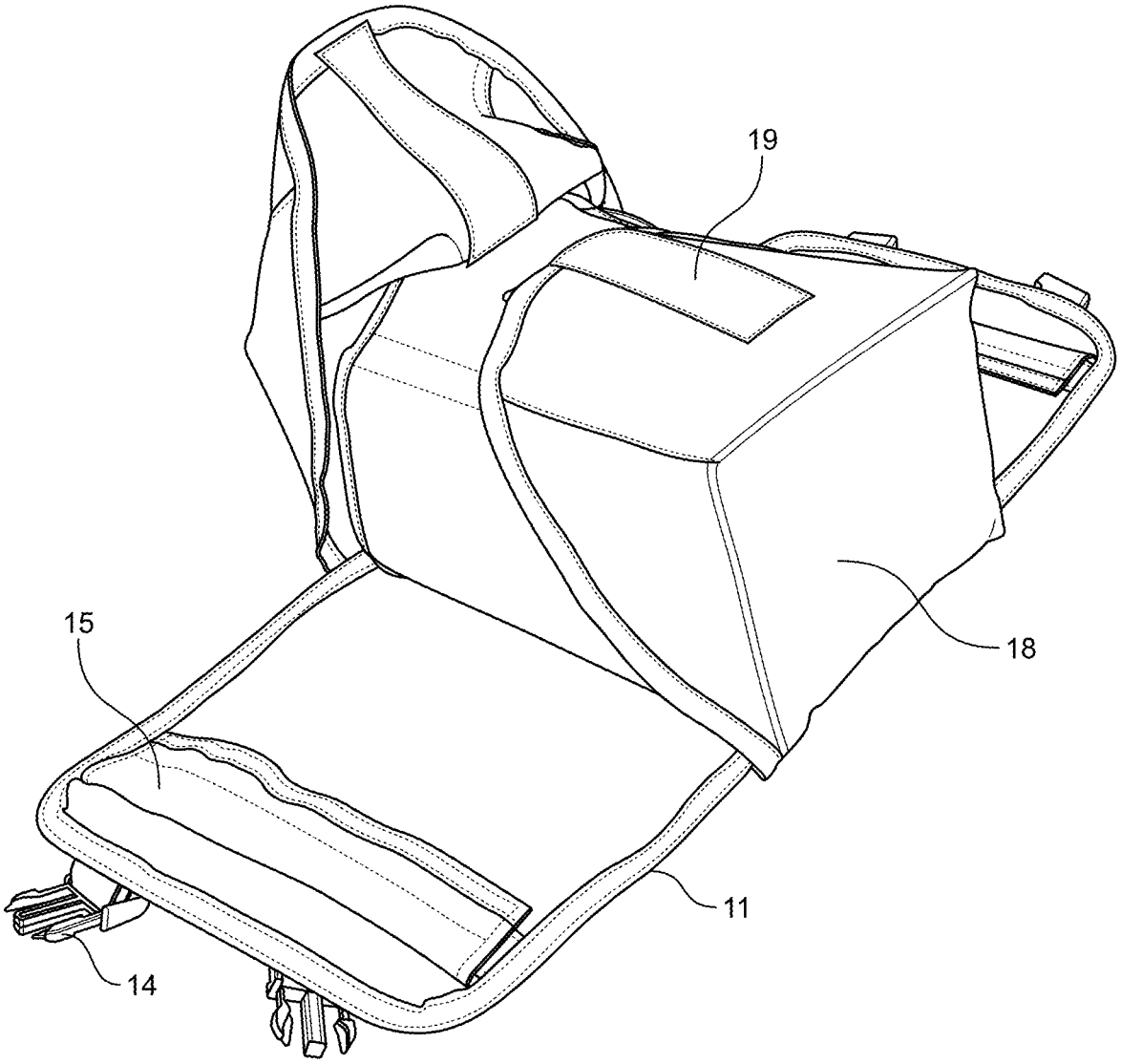
FIG. 2 is a perspective view illustrating the modular utility kit according to the present exemplary embodiment.
Figure 3:
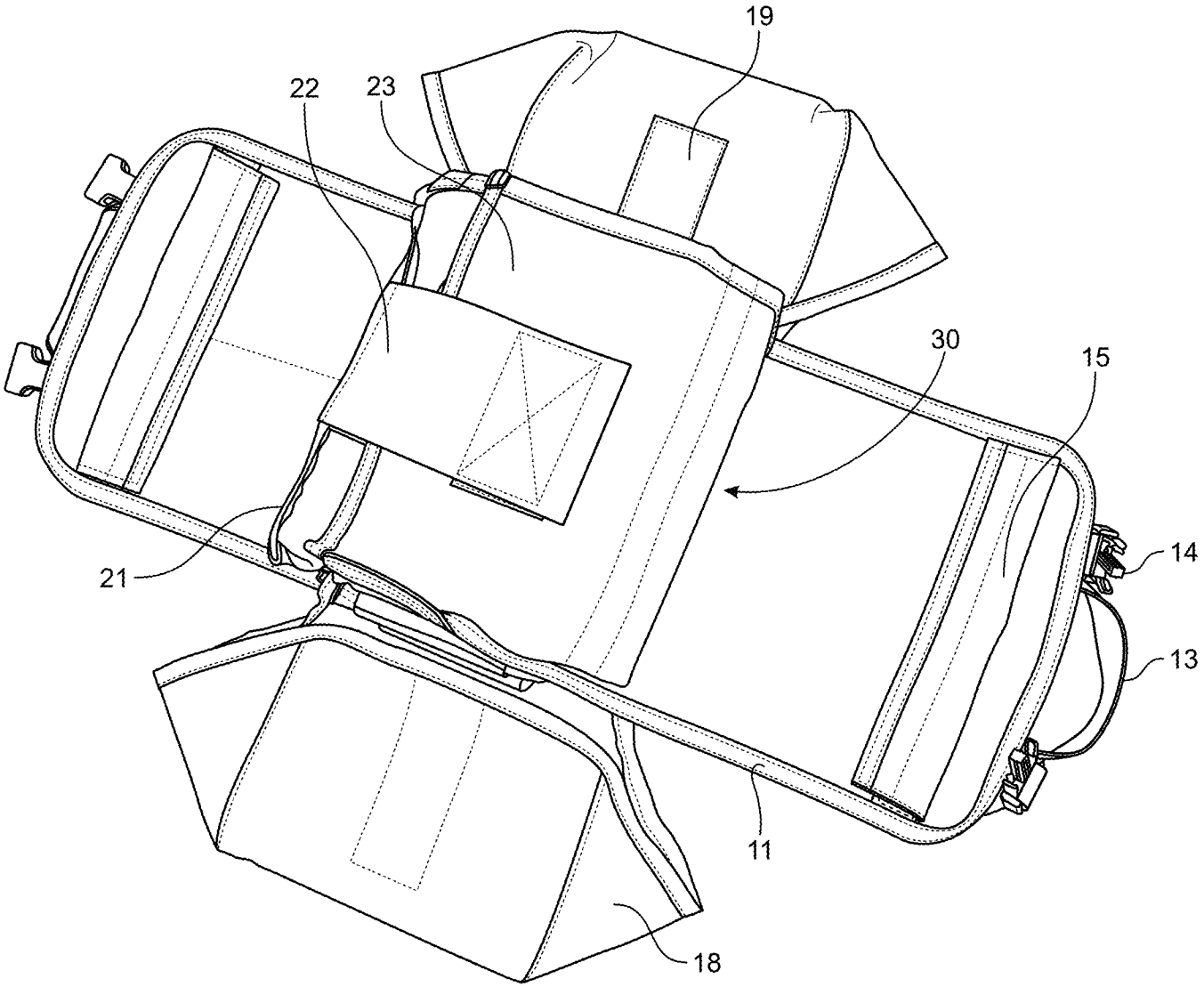
FIG. 3 is an overhead view illustrating the modular utility kit according to the present exemplary embodiment.

As shown in FIG. 2 and FIG. 3, when the buckles 14 are released, the outer shell cover 11 may expand and lie flat, revealing a pair of interior pockets 15, on each of the inner sides of the outer shell cover 11. The pockets 15 provide additional storage, and may be segmented and held closed using hook and loop material. A core 30 of the modular utility kit 1 may be partially covered by the inner shell cover 18. The inner shell cover 18 also serves as an additional barrier against dirt and water intrusion and may be constructed of two overlapping rectangular fabric covers joined together with a retainer strap 19. The retainer strap 19 may be a strip of hook and loop material affixed to each side of the inner shell cover 18. When the retainer strap 19 is released, the two halves of the inner shell cover 18 may lay flat, revealing a core 30 comprising a stacked assemblage of pouches.

The pouches in the core 30 are arranged on and connected to core wing flaps, which cover the exterior of the core 30. As shown in FIG. 3, the core 30 is maintained in a cube-like shape by a first core wing flap 21 secured to a second core wing flap 23 by a binding strap 22. The binding strap 22 may be made of flexible material connected to the first core wing flap 21 with a strip of hook and loop material affixed on an underside thereof, with a strip of hook and loop material affixed to an outer surface of the second core wing flap 23.

Figure 4:
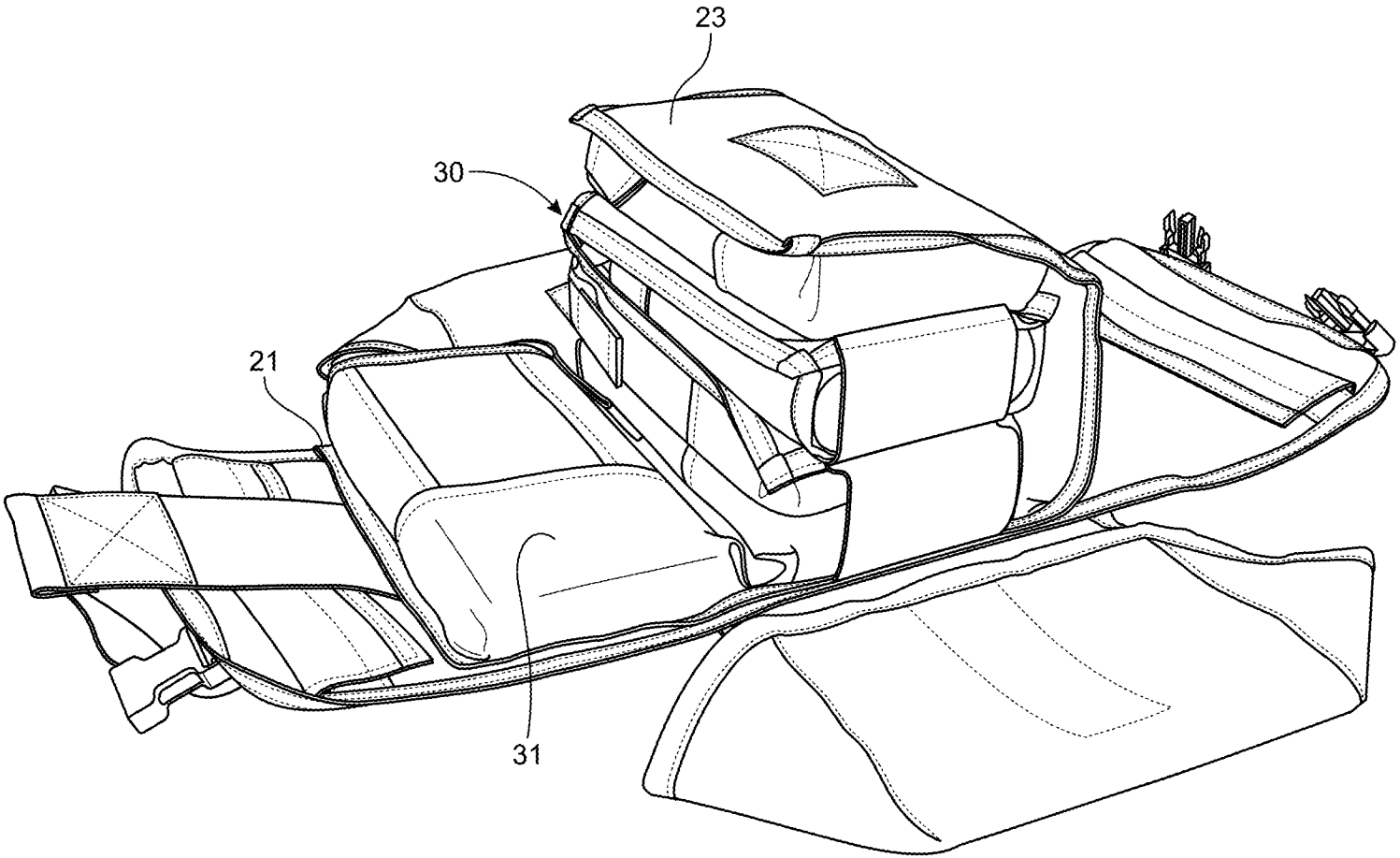
FIG. 4, FIG. 5, FIG. 6, FIG. 7, and FIG. 8 are perspective views illustrating the modular utility kit according to the present exemplary embodiment.

Once the binding strap 22 is released from the second core wing flap 23, the core 30 may be un-stacked. As shown in FIG. 4, the first core wing flap 21 may be unfolded 90° from its initial position to lie flat (i.e., along a substantially horizontal plane), with a first pouch 31 connected thereto. Thus, the first pouch 31 may be unfolded 90° from its initial position to lie flat and be exposed. Prior to unfolding, the first core wing flap 21 covers a side surface of the core 30. The first pouch 31 according to the present exemplary embodiment is made of rectangular fabric and has a window therein, so that the contents may be instantly recognizable, as will be described in greater detail below. The window may be made of flexible, clear plastic. Each pouch may house a durable, clear plastic container that provides instant recognizability of the tools and supplies stored within each.

Figure 5:
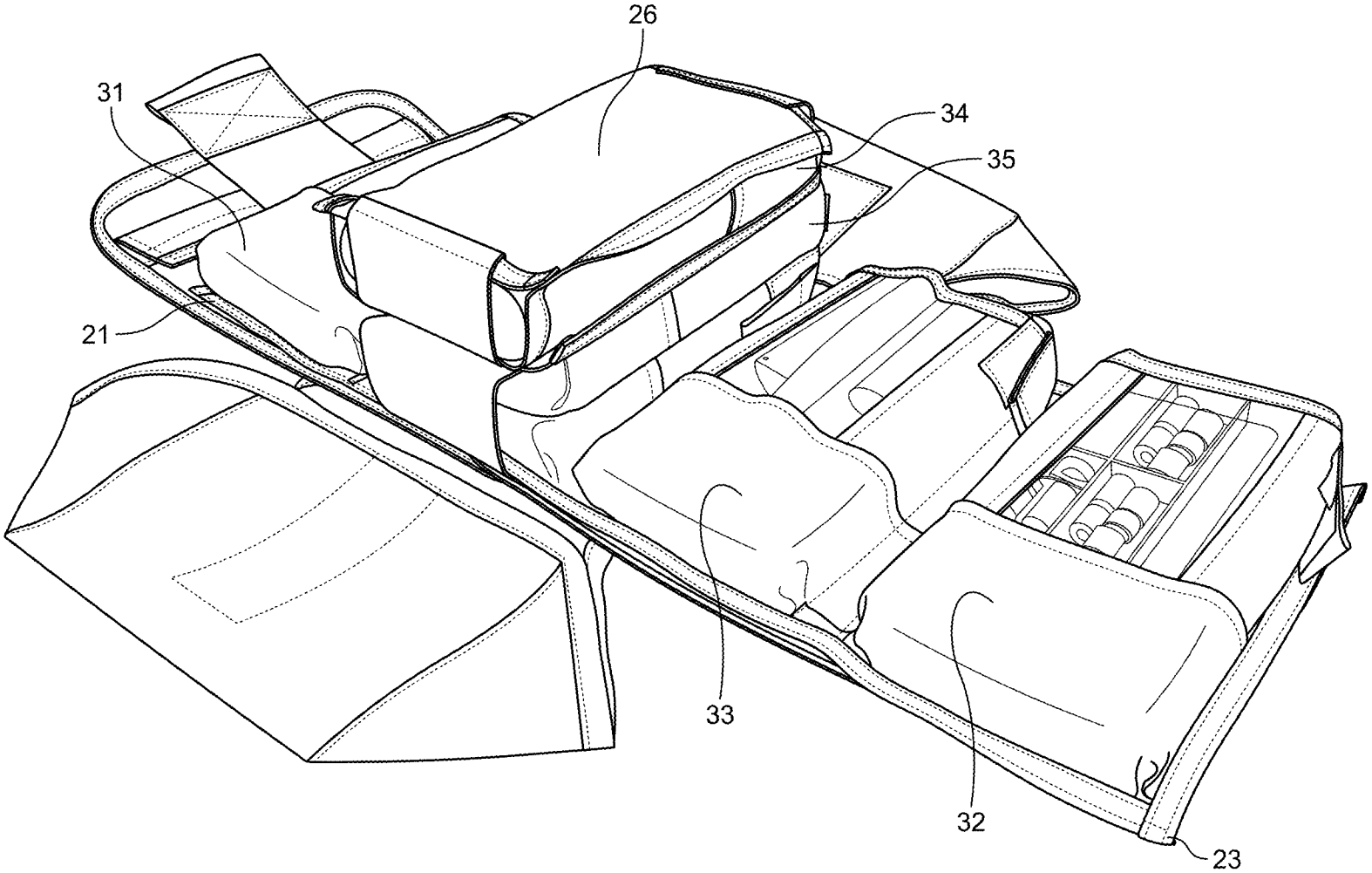

As shown in FIG. 5, once the binding strap 22 is released from the second core wing flap 23, the second core wing flap 23 may be unfolded from its initial position to lie flat, with a second pouch 32 and a third pouch 33 connected thereto being exposed. A first part of the second core wing flap 23 having the second pouch 32 thereon may be unfolded 180° from its initial position to lie flat. A second part of the second core wing flap 23 having the third pouch 33 thereon may be unfolded 90° from its initial position to lie flat. That is, prior to unfolding, the second core wing flap 23 covers side and top surfaces of the core 30. The first core wing flap 21 and the second core wing flap 23 are made of a continuous piece of material. The unfolded first pouch 31 is on an opposite side of the core 30 from the unfolded second pouch 32 and third pouch 33.

Figure 6:
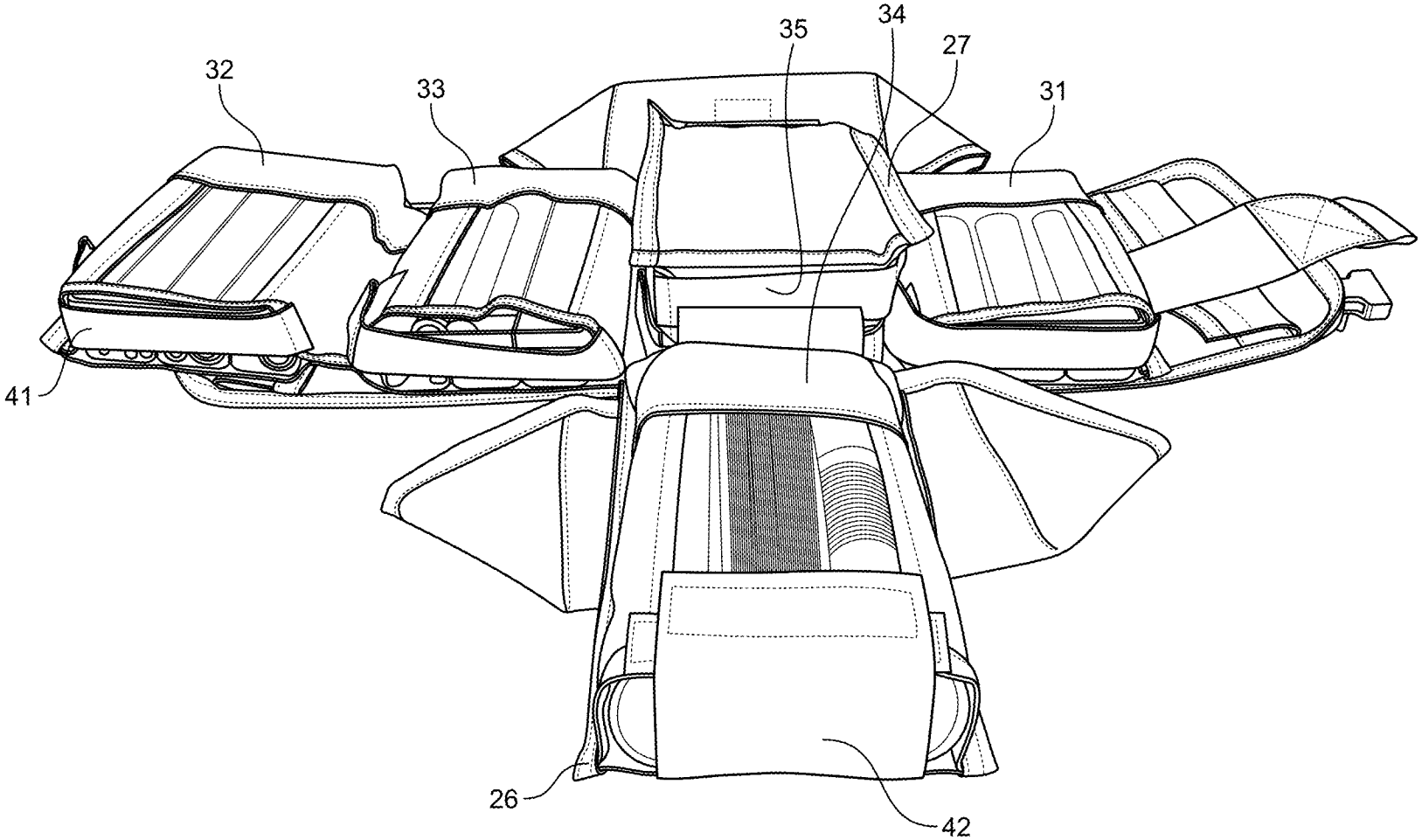

The core 30 also includes a fourth pouch 34, fifth pouch 35, and sixth pouch 36, which are stacked on each other. As shown in FIG. 6, once the second core wing flap 23 is unfolded from its initial position, a third core wing flap 26 may be unfolded from its initial position to lie flat, with the fourth pouch 34 connected thereto being exposed. The third core wing flap 26 covers an upper interior surface of the core 30, and may be unfolded 180° from its initial position to lie flat. The third core wing flap 26 unfolds in a direction substantially perpendicular to the unfolding direction of the first core wing flap 21 and the second core wing flap 23. Thus, the fourth pouch 34 may be unfolded 180° from its initial position to lie flat and be exposed, the unfolded fourth pouch 34 being arranged substantially perpendicular to the first pouch 31, the second pouch 32, and the third pouch 33.

Figure 7:
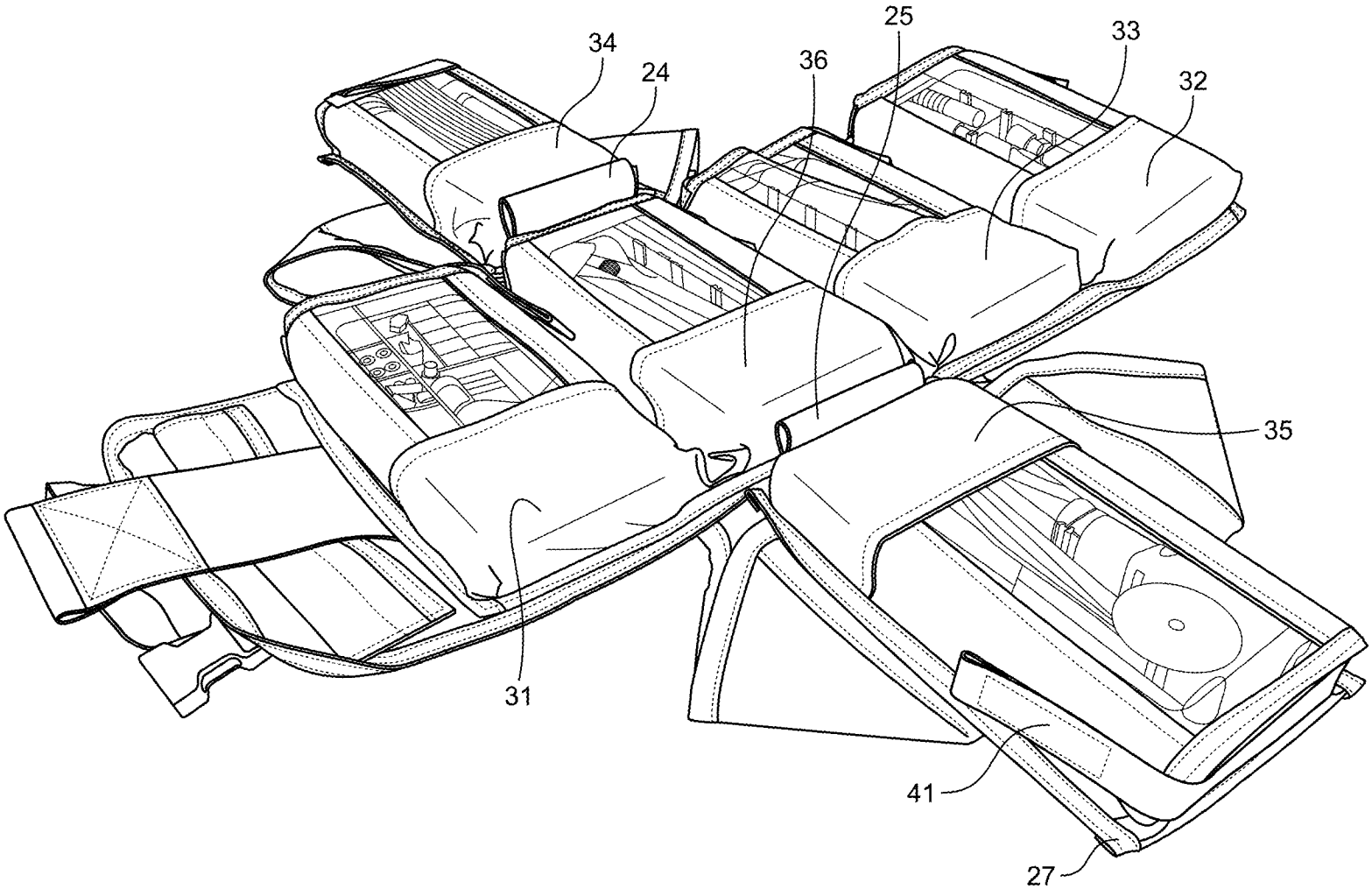

Once the third core wing flap 26 is unfolded from its initial position, a fourth core wing flap 27 may be unfolded to lie flat, with the fifth pouch 35 connected thereto being exposed, as shown in FIG. 7. The fourth core wing flap 27 covers an upper interior surface of the core 30, and may be unfolded 180° from its initial position to lie flat. Thus, the fifth pouch 35 may be unfolded 180° from its initial position to lie flat and be exposed. The fourth core wing flap 27 unfolds in a direction opposite to the third core wing flap 26, and in a direction substantially perpendicular to the unfolding direction of the first core wing flap 21 and the second core wing flap 23. Thus, the fifth pouch 35 may be unfolded 180° from its initial position to lie flat and be exposed, the unfolded fifth pouch 35 being arranged substantially perpendicular to the first pouch 31, the second pouch 32, and the third pouch 33.

The third core wing flap 26 is connected to the first core wing flap 21 and the second core wing flap 23 by a first connector strap 24. The fourth core wing flap 27 is connected to the first core wing flap 21 and the second core wing flap 23 by a second connector strap 25. The first connector strap 24 and the second connector strap 25 may be made of a flexible material, such as the same material used for the binding strap 22. The third core wing flap 26 and the fourth core wing flap 27 are each separate pieces of material.

Once the fourth core wing flap 27 is unfolded from its initial position, the sixth pouch 36 is exposed. The sixth pouch 36 is connected to the continuous material forming the first core wing flap 21 and the second core wing flap 23. Thus, the first pouch 31, the sixth pouch 36, the second pouch 32, and the third pouch 33 are sequentially aligned on the continuous material forming the first core wing flap 21 and the second core wing flap 23.

Figure 8:
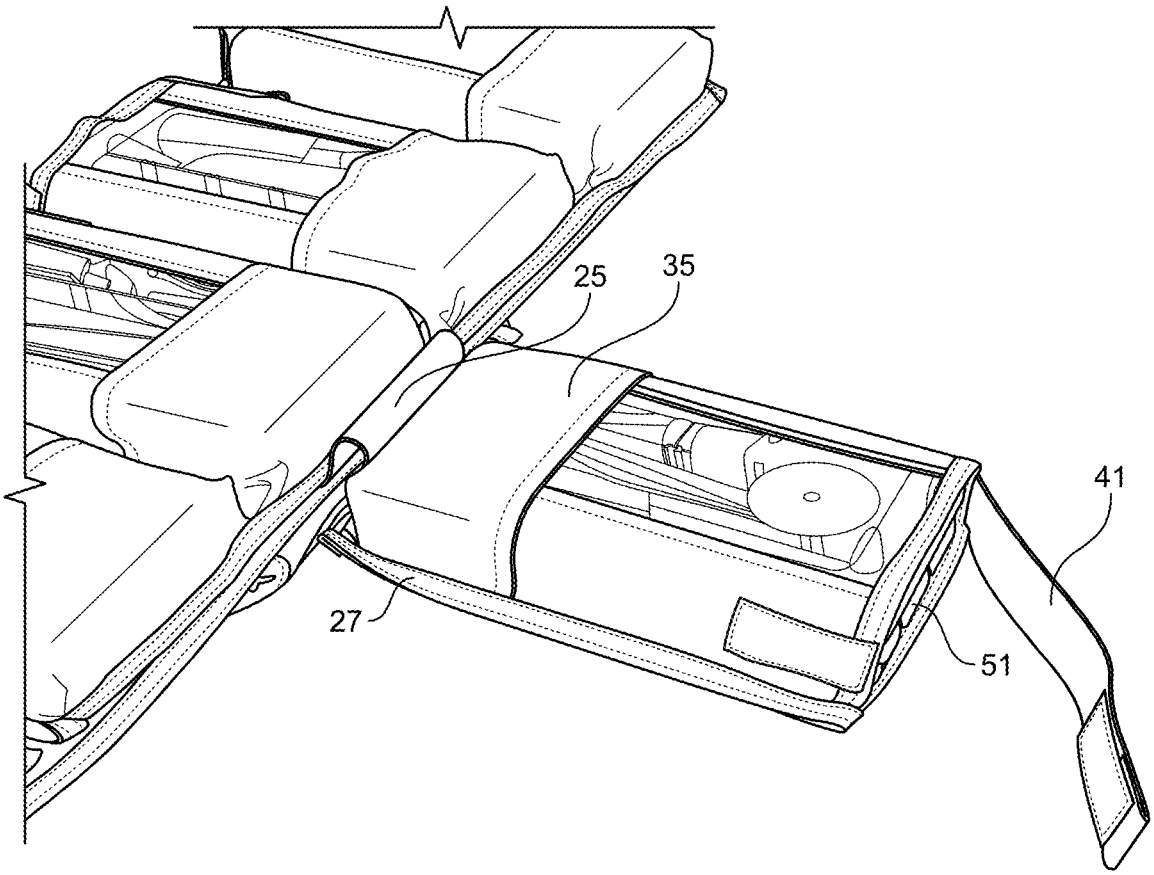

The pouches are enclosed on all sides but one, and have an open end for accommodating a container or other materials therein. As shown in FIG. 8, the fifth pouch 35 has a first cover strap 41 at the open end thereof, which is configured to secure a container 51. The first cover strap 41 may be made of flexible material connected to a first side edge of the fifth pouch 35, with a strip of hook and loop material affixed on a distal end thereof. Another strip of hook and loop material is affixed to a second side edge of the fifth pouch 35, so the distal end of the first cover strap may be detachably connected to the fifth pouch 35 and secure the open end thereof. The first cover strap 41 is configured to only cover the open end of the pouch and the side edge portions where it is connected to the pouch. The first cover strap 41 may be used in conjunction with each of the first through sixth pouches 31-36.

As shown in FIG. 6, the fourth pouch 34 has a second cover strap 42 at the open end thereof. The second cover strap 42 may be made of flexible material connected to the third core wing flap 26, with a strip of hook and loop material affixed on a distal end thereof. Another strip of hook and loop material is affixed to a top edge of the fourth pouch 34, so the distal end of the second cover strap 42 may be detachably connected to the fourth pouch 34 and secure the open end thereof. The second cover strap 42 covers the open end of the pouch and the top edge where it is connected to the fourth pouch 34.

By using a first cover strap 41 that connects to side edges of a pouch, the pouches may be stacked in a level manner. That is, since the second pouch 32, fourth pouch 34, fifth pouch 35, and sixth pouch 36 are all vertically stacked in the core 30, the first cover strap 41 may be used thereon in order to avoid an uneven thickness of the core 30. Likewise, since the first pouch 31 and the third pouch 33 are vertically aligned with the stacked pouches in the core 30, utilizing the first cover strap 41 may avoid an uneven width of the core 30.

A modular utility kit 100 according to an exemplary embodiment is shown in FIG. 9, FIG. 10, FIG. 11, FIG. 12, FIG. 13, FIG. 14, and FIG. 15. The modular utility kit 100 may be substantially similar in various respects to the modular utility kit 1 as described above with respect to FIG. 1, FIG. 2, FIG. 3, FIG. 4, FIG. 5, FIG. 6, FIG. 7, and FIG. 8 of the present application, and the disclosure thereof is incorporated herein by reference, and any repeated disclosure may be omitted for the sake of brevity. Likewise, the disclosure with respect to the modular utility kit 100 described in connection with FIG. 9, FIG. 10, FIG. 11, FIG. 12, FIG. 13, FIG. 14, and FIG. 15 is incorporated by reference into the exemplary embodiment described with respect to FIG. 1, FIG. 2, FIG. 3, FIG. 4, FIG. 5, FIG. 6, FIG. 7, and FIG. 8.

An exemplary embodiment is directed to a modular utility kit 100 employing a containerized storage system, as shown in FIG. 9, FIG. 10, FIG. 11, FIG. 12, FIG. 13, FIG. 14, and FIG. 15. The modular utility kit 100 includes a six-sided, cube-like, fabric bag, having an outer shell cover 111 and inner shell cover 118. The outer shell cover 111 and the inner shell cover 118 completely surrounds the two longer parallel front and back sides, the two shorter parallel left and right sides, the bottom, and nearly the entire top where the outer shell cover 111 is closed and opened. The modular utility kit 100 according to the present exemplary embodiment has a length of about 11 inches, a width of about 8.5 inches, and a height of about 8.5 inches. The outer shell cover 111 and inner shell cover 118 may each be constructed of a durable fabric material that is resistant to water and dirt infiltration.

Attached in parallel at the top edges of both sides of the outer shell cover 111 is a pair of compression straps 113 coupled together with a pair of quick-release, adjustable buckles 114 which are configured to securely fasten the outer shell cover 111 closed. The compression straps 113 include a pair of looped fabric handles 115 affixed in parallel onto the exterior of the outer shell cover 111 and encircle the exterior of the outer shell cover 111, and come together and meet at the modular utility kit's 100 upper side. Adjustable compression straps 113 may be attached to the outer shell cover 111 at the upper side of the modular utility kit 100.

When the buckles 114 are released, the outer shell cover 111 may expand and lie flat, revealing a pair of interior pockets 117, on each of the inner sides of the outer shell cover 111. The pockets 117 provide additional storage, and may be segmented and held closed using hook and loop material. A core 130 of the modular utility kit 100 may be partially covered by the inner shell cover 118. The inner shell cover 118 also serves as an additional barrier against dirt and water intrusion and may be constructed of two overlapping rectangular fabric covers joined together with a retainer strap 119. The retainer strap 119 may be a strip of hook and loop material affixed to each side of the inner shell cover 118. When the retainer strap 119 is released, the two halves of the inner shell cover 118 may lay flat, revealing a core 130 comprising a stacked assemblage of pouches.

Figure 9:
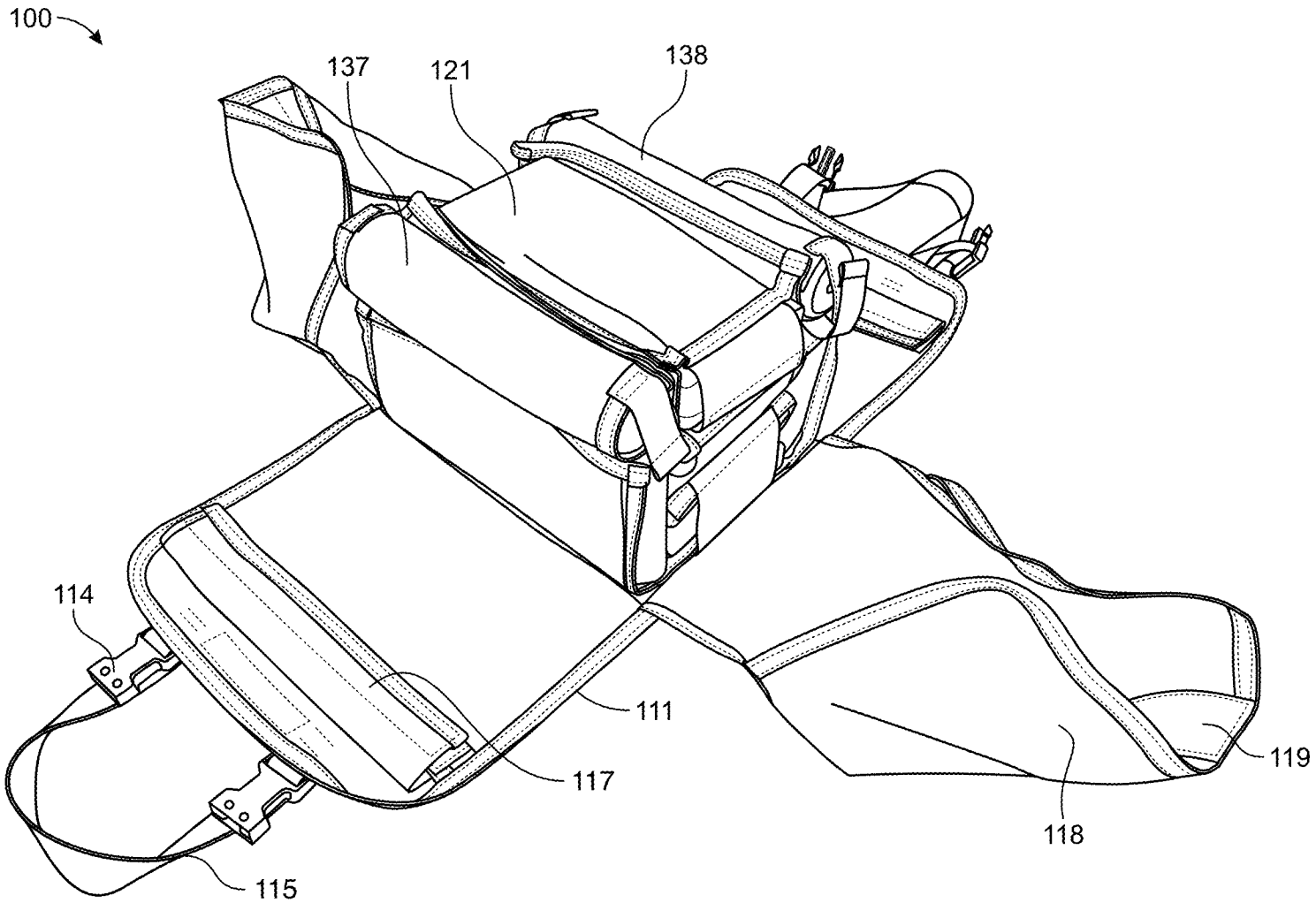
FIG. 9 is a perspective view illustrating a modular utility kit according to an exemplary embodiment.
Figure 10:
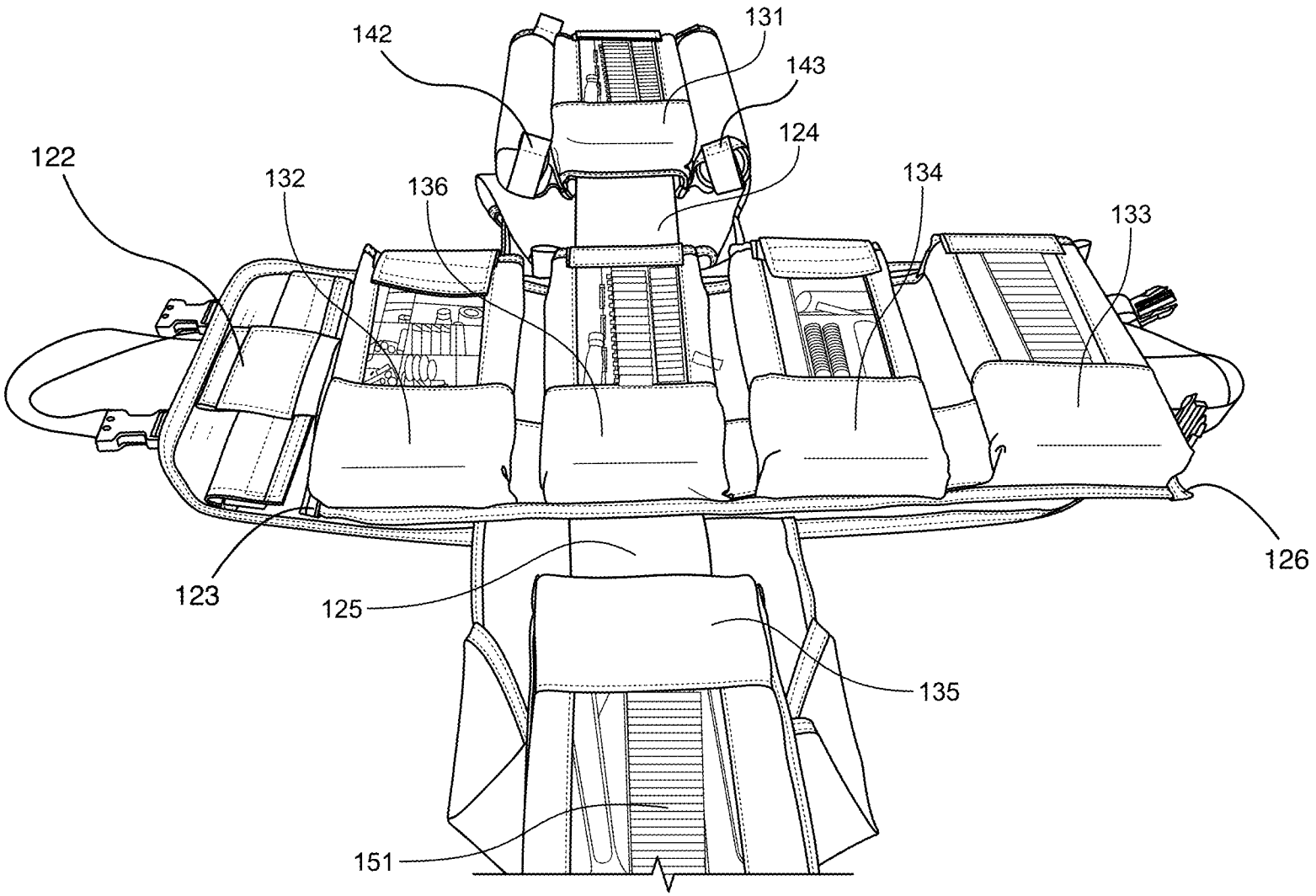
FIG. 10, FIG. 11, FIG. 12, FIG. 13, FIG. 14, and FIG. 15 are perspective views illustrating the modular utility kit according to the present exemplary embodiment.
Figure 11:
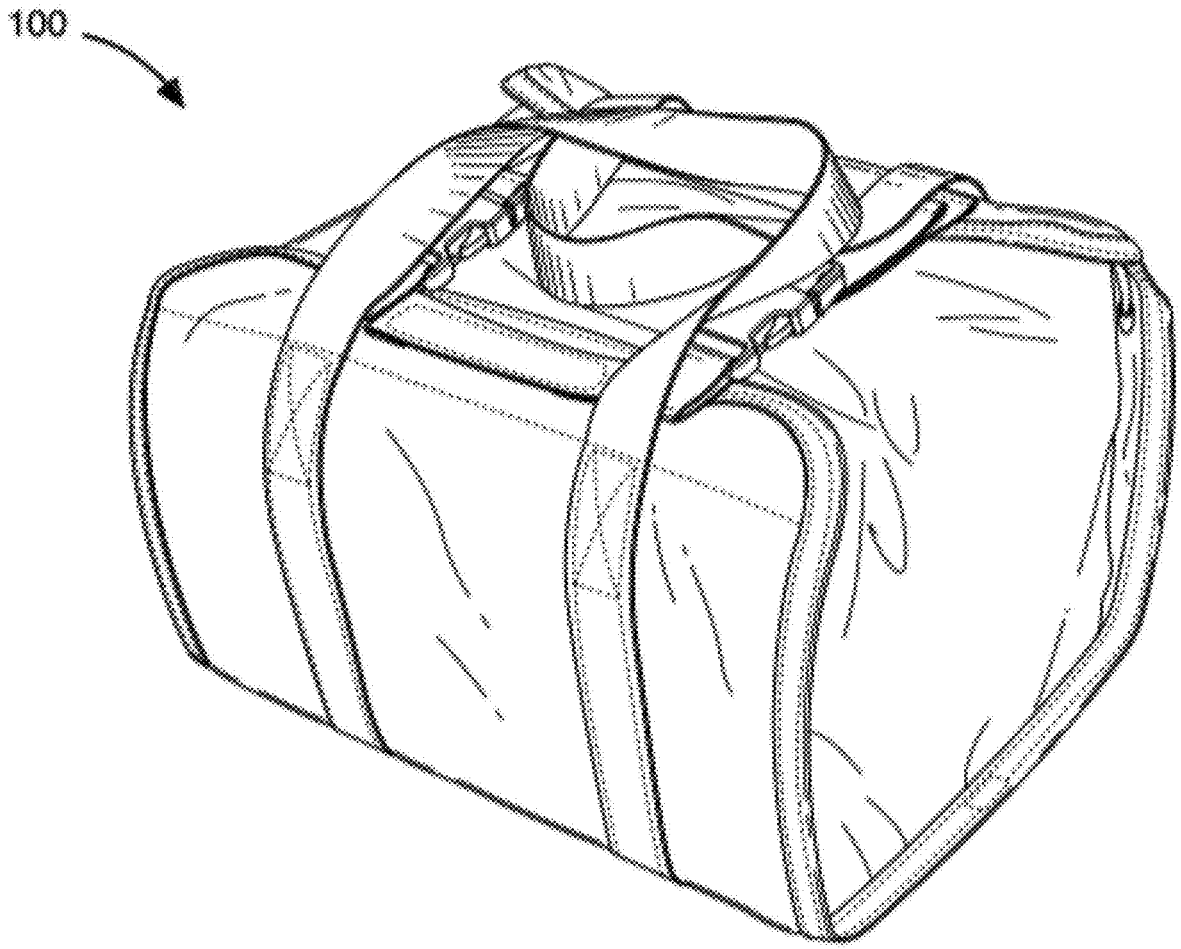
Figure 12:
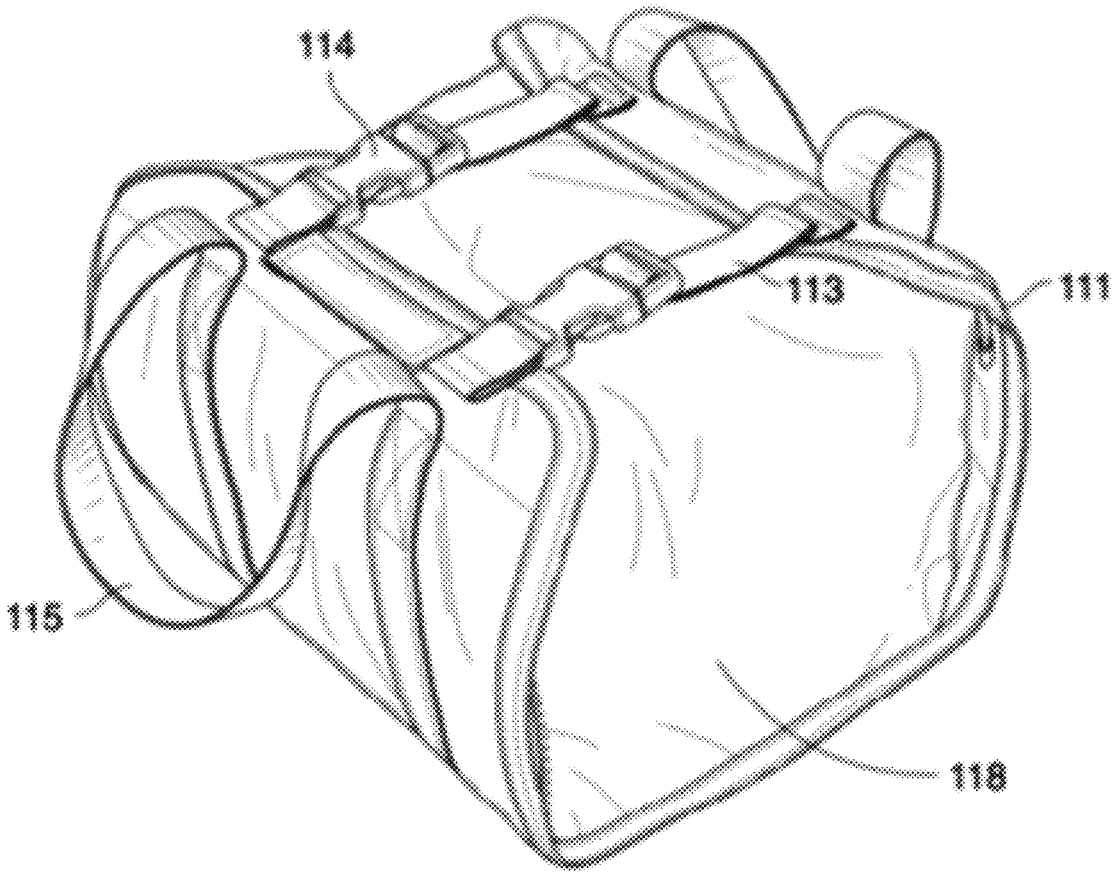
Figure 13:
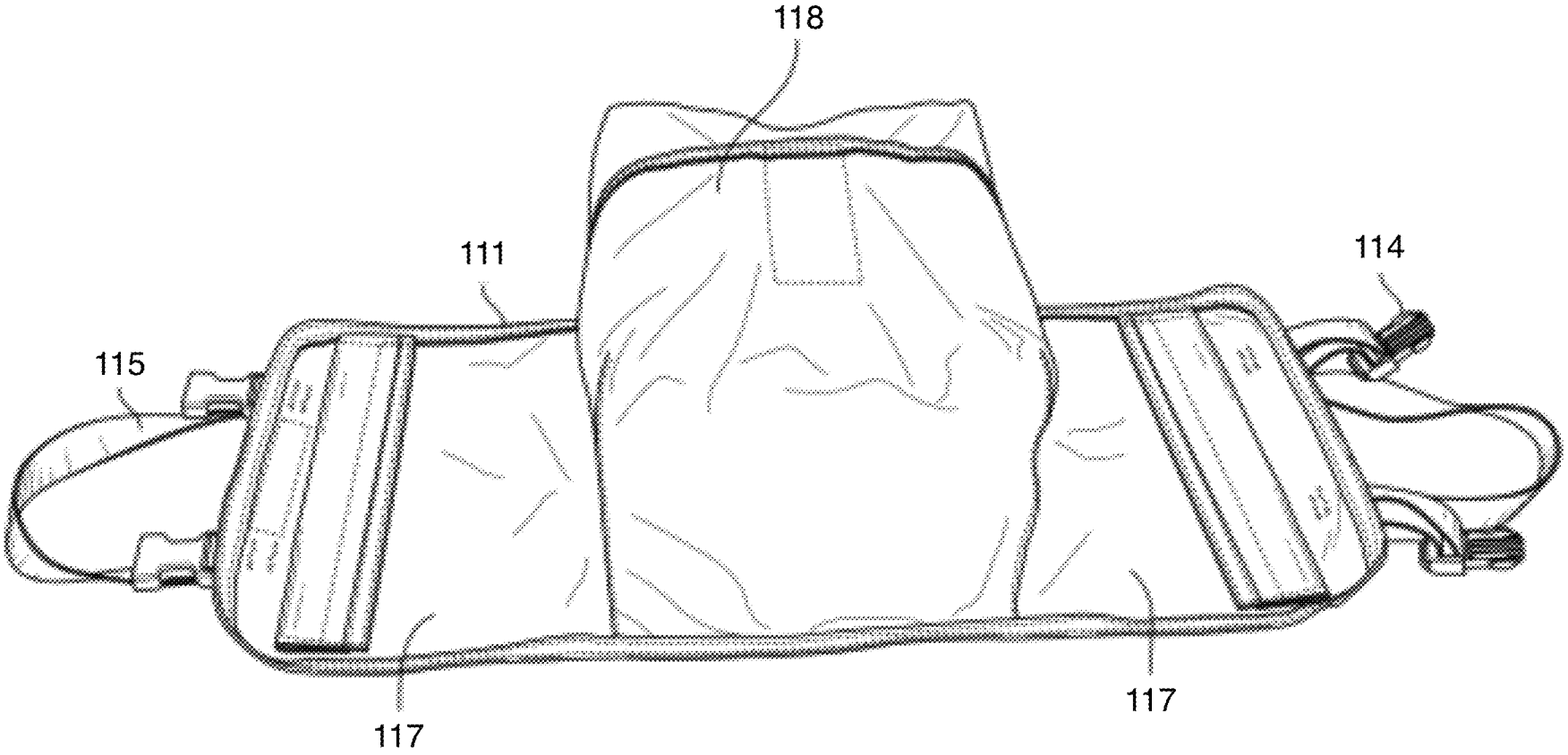
Figure 14:
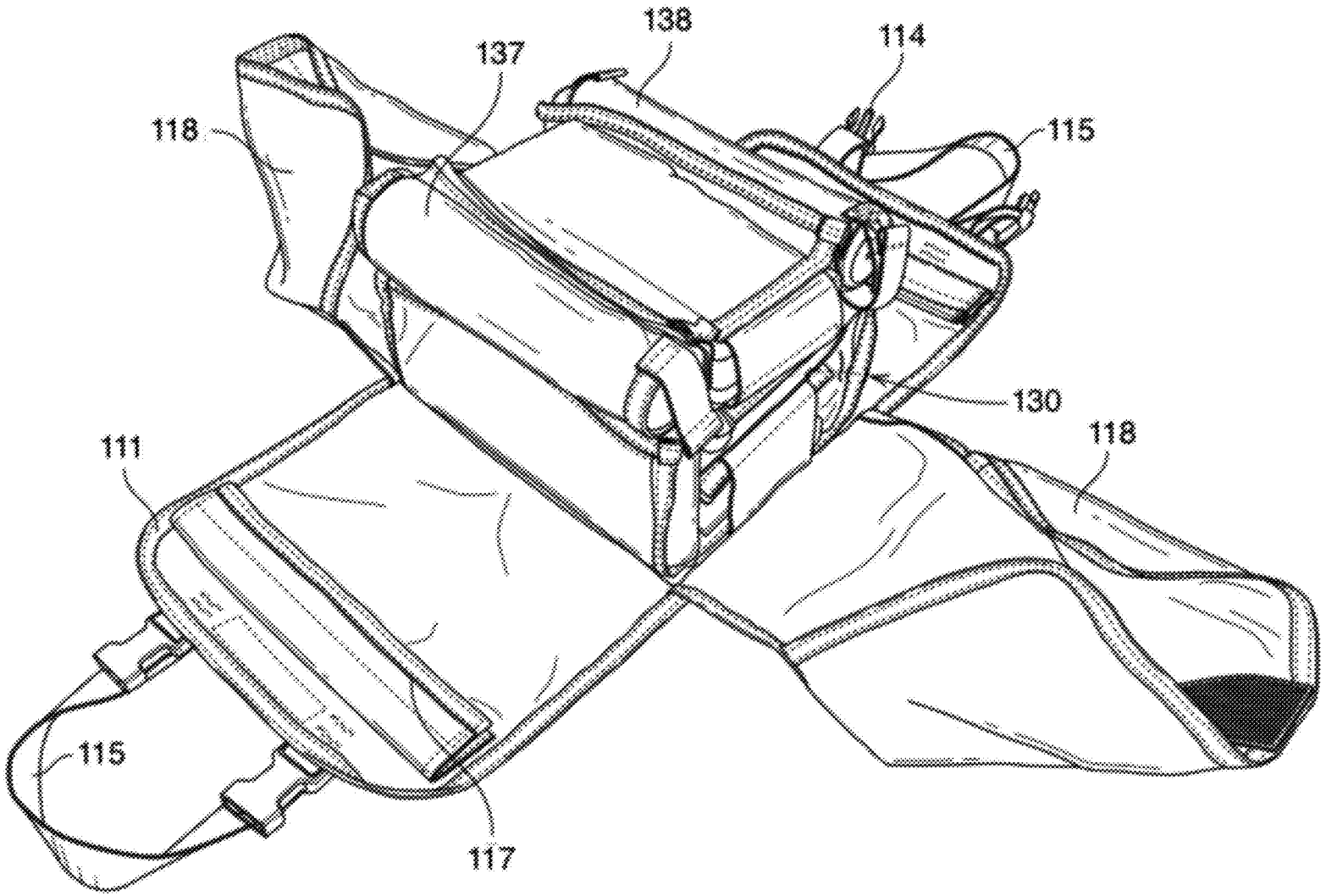
Figure 15:
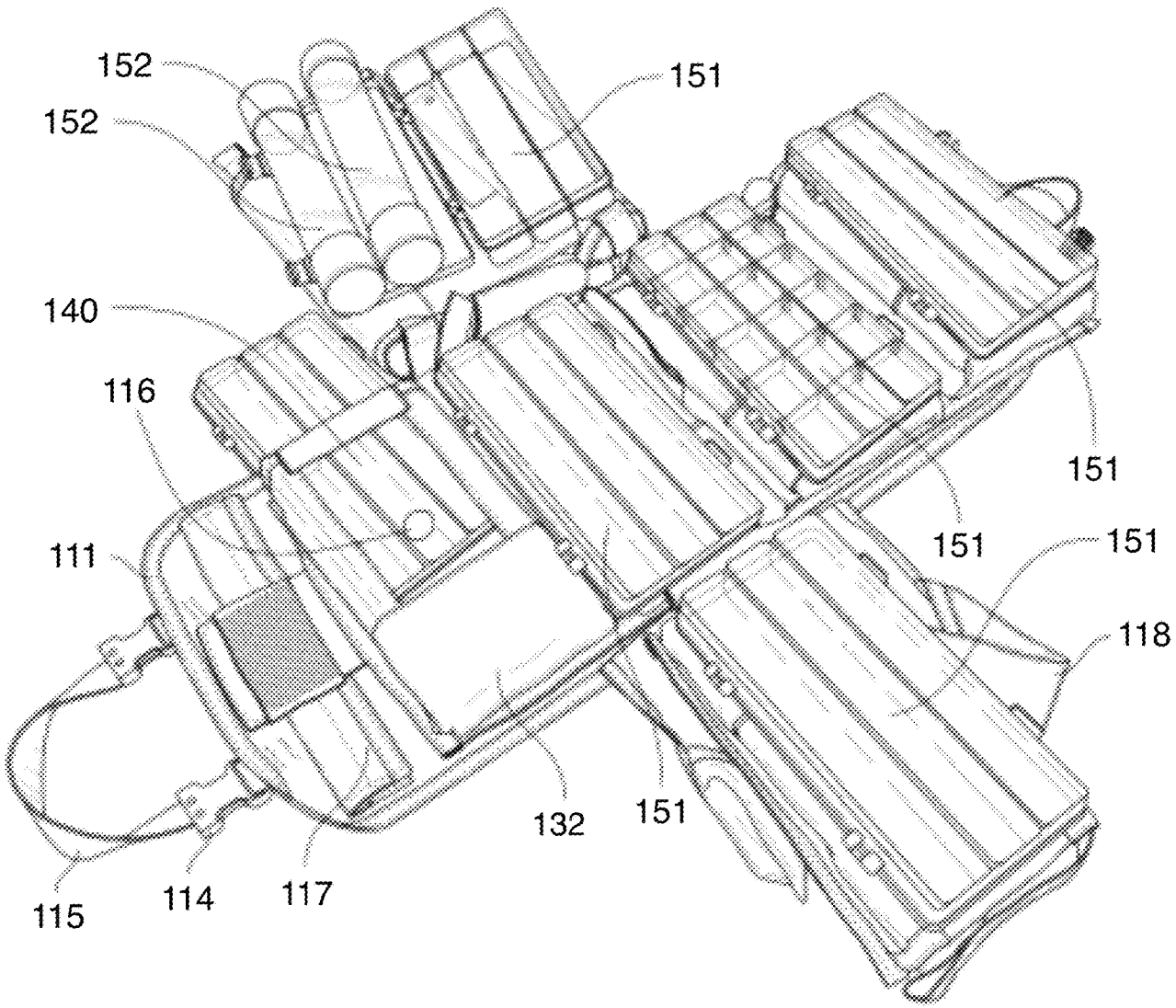

As shown in FIG. 9, attached to and alongside the first pouch 131 are two tubular pockets, first cylinder pouch 137 and second cylinder pouch 138, which provide additional storage space for a variety of supplies. Each of the first cylinder pouch 137 and second cylinder pouch 138 may be made of fabric, and have a closure strip of hook and loop material providing retention and accessibility thereto. Unfastening the two halves of the inner shell cover 118 and allowing them to fall away and lay flat reveals the core 130 of stacked assemblage of conformal, rectangular pouches.

A first core wing flap 121 may be unfolded from its initial position to lie flat, with the first pouch 131 connected thereto being exposed, along with the first cylinder pouch 137 and second cylinder pouch 138. The first core wing flap 121 covers an upper surface of the core 130, and may be unfolded 180° from its initial position to lie flat. Thus, the first pouch 131, first cylinder pouch 137, and second cylinder pouch 138 may be unfolded 180° from their initial positions to lie flat and be exposed.

A second core wing flap 123 may be secured to a third core wing flap 126 by a binding strap 122. The binding strap 122 may be made of flexible material connected to the second core wing flap 123 with a strip of hook and loop material affixed on an underside thereof, with a strip of hook and loop material affixed to an outer surface of the third core wing flap 126. Once the first core wing flap 121 is unfolded from its initial position, the binding strap 122 may be released from the third core wing flap 126, and the core 130 may be further un-stacked. The second core wing flap 123 may be unfolded 90° from its initial position to lie flat, with a second pouch 132 connected thereto. Thus, the second pouch 132 may be unfolded 90° from its initial position to lie flat and be exposed. Prior to unfolding, the second core wing flap 123 covers a side surface of the core 130.

Each pouch 131-138 may have a flexible, clear plastic window 140 to provide immediate identification of their contents. Each pouch 131-138 may contain a clear plastic container 151 or clear plastic tubular container 152 stored inside. The containers 151 and 152 may provide for instant recognition of their stored contents.

Once the binding strap 122 is released from the third core wing flap 126, the third core wing flap 126 may be unfolded from its initial position to lie flat, with a third pouch 133 and a fourth pouch 134 connected thereto being exposed. A first part of the third core wing flap 126 having the third pouch 133 thereon may be unfolded 180° from its initial position to lie flat. A second part of the third core wing flap 126 having the fourth pouch 134 thereon may be unfolded 90° from its initial position to lie flat. That is, prior to unfolding, the third core wing flap 126 covers side and interior top surfaces (i.e., under the first core wing flap 121 and first pouch 131) of the core 130. The second core wing flap 123 and the third core wing flap 126 are made of a continuous piece of material.

The unfolded second pouch 132 is on an opposite side of the core 130 from the unfolded third pouch 133 and fourth pouch 134. The first core wing flap 121 unfolds in a direction substantially perpendicular to the unfolding direction of the second core wing flap 123 and the third core wing flap 126. Thus, the unfolded first pouch 131 being arranged substantially perpendicular to the second pouch 132, the third pouch 133 and the fourth pouch 134.

The core 130 also includes a fifth pouch 135 and sixth pouch 136, which are stacked on each other. Once the third core wing flap 126 is unfolded from its initial position, a fourth core wing flap 127 may be unfolded to lie flat, with the fifth pouch 135 connected thereto being exposed. The fourth core wing flap 127 covers an upper interior surface of the core 130, and may be unfolded 180° from its initial position to lie flat. Thus, the fifth pouch 135 may be unfolded 180° from its initial position to lie flat and be exposed. The fourth core wing flap 127 unfolds in a direction opposite to the first core wing flap 121, and in a direction substantially perpendicular to the unfolding direction of the second core wing flap 123 and the third core wing flap 126. Thus, the fifth pouch 135 may be unfolded 180° from its initial position to lie flat and be exposed, the unfolded fifth pouch 135 being arranged substantially perpendicular to the second pouch 132, the third pouch 133, and the fourth pouch 134.

The first core wing flap 121 is connected to the second core wing flap 123 and the third core wing flap 126 by a first connector strap 124. The fourth core wing flap 127 is connected to the second core wing flap 123 and the third core wing flap 126 by a second connector strap 125. The first connector strap 124 and the second connector strap 125 may be made of a flexible material, such as the same material used for the binding strap 122. The first core wing flap 121 and the fourth core wing flap 127 are each separate pieces of material.

Once the fourth core wing flap 127 is unfolded from its initial position, the sixth pouch 136 is exposed. The sixth pouch 136 is connected to the continuous material forming the second core wing flap 123 and the third core wing flap 126. Thus, the second pouch 132, the sixth pouch 136, the third pouch 133, and the fourth pouch 134 are sequentially aligned on the continuous material forming the second core wing flap 123 and the third core wing flap 126.

The pouches are enclosed on all sides but one, and have an open end for accommodating a container 151 or other materials therein, as described above with respect to the modular utility kit 1 and in greater detail below. The pouches each have a first cover strap 142 at the open end thereof. The first cover strap 142 may be made of flexible material connected to the respective pouch or core wing flap, with a strip of hook and loop material affixed on a distal end thereof. Another strip of hook and loop material is affixed to a top edge of the respective pouch, so the distal end of the first cover strap 142 may be detachably connected to the pouch and secure the open end thereof. The first cover strap 142 covers the open end of the pouch and the top edge where it is connected to the respective pouch.

The first cylinder pouch 137 and second cylinder pouch 138 have a second cover strap 143 at the open end thereof, which is configured to secure a tubular container 152. The second cover strap 143 may be made of flexible material connected to a first side edge of the first cylinder pouch 137 or second cylinder pouch 138, with a strip of hook and loop material affixed on a distal end thereof. Another strip of hook and loop material is affixed to a second side edge of the respective first cylinder pouch 137 or second cylinder pouch 138, so the distal end of the second cover strap 143 may be detachably connected to the respective first cylinder pouch 137 or second cylinder pouch 138 and secure the open end thereof. The second cover strap 143 is configured to only cover the open end of the first cylinder pouch 137 or second cylinder pouch 138 and the side edge portions where it is connected thereto.

When the need for the modular utility kit's 100 contents are no longer required and each container 151 and/or tubular container 152 are returned securely back into their respective pouches 131-138 and pockets 117, the core 130 may re-assembled with the assistance of marking tabs 116 affixed to each of the pouches. Guided by the marking tabs 116, which may be colored and on the exterior of each pouch, the modular utility kit 100 may be easily re-assembled and secured back together inside the inner shell cover 118. The outer shell cover 111 is then folded up to close and secured with the compression straps 113 and the buckles 114.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

I claim:

1. A modular utility kit, comprising:

a core comprising a first pouch, a second pouch, a third pouch, a fourth pouch, a fifth pouch, and a sixth pouch;

a first shell comprising a first wing flap and a second wing flap detachably surrounding the core;

a second shell comprising an inner shell cover detachably surrounding the first shell and the core; and a third shell comprising an outer shell cover detachably surrounding the second shell, the first shell, and the core, wherein:

the second pouch, the fourth pouch, the fifth pouch, and the sixth pouch are respectively vertically stacked in the core;

the first pouch and the third pouch are each disposed at a 90-degree angle with respect to the second pouch, the fourth pouch, the fifth pouch, and the sixth pouch in the core;

the first pouch, the sixth pouch, the third pouch, and the second pouch are arranged on a first surface of the first shell;

a second surface of the first shell is an opposite side of the first shell from the first surface thereof;

the first pouch is configured to unfold 90 degrees from the core to lie along a substantially horizontal plane;

the second pouch is configured to unfold 180 degrees from the core to lie along the substantially horizontal plane; and the third pouch is configured to unfold 90 degrees from the core to lie along the substantially horizontal plane.

2. The modular utility kit of claim 1, wherein the second surface of the first shell is an outer surface thereof detachably surrounding the core.

3. The modular utility kit of claim 1, further comprising:

a first connector strap connecting the fourth pouch to the first shell; and a second connector strap connecting the fifth pouch to the first shell.

4. The modular utility kit of claim 1, wherein the first shell is configured to unfold and extend along the substantially horizontal plane.

5. The modular utility kit of claim 4, wherein:

the first pouch is arranged on the first wing flap; and the second pouch and the third pouch are arranged on the second wing flap.

6. The modular utility kit of claim 1, wherein:

the fourth pouch is configured to unfold 180 degrees from the core to lie along the substantially horizontal plane; and the fifth pouch is configured to unfold 180 degrees from the core to lie along the substantially horizontal plane, the fourth pouch and the fifth pouch are configured to unfold in opposite directions from the core.

7. The modular utility kit of claim 6, wherein the fourth pouch and the fifth pouch are configured to unfold in directions orthogonal to an unfolding direction of the first pouch, the second pouch, and the third pouch, with respect to the core.

8. A modular utility kit comprising:

a core comprising a first pouch, a second pouch, a third pouch, a fourth pouch, a fifth pouch, and a sixth pouch; and a first shell comprising a first wing flap and a second wing flap detachably surrounding the core, wherein:

the core is configured to be unfolded;

the first pouch, the second pouch, the third pouch, and the sixth pouch are disposed between the fourth pouch and the fifth pouch, and the first shell, in the core;

the second pouch, the fourth pouch, the fifth pouch, and the sixth pouch are respectively vertically stacked in the core;

the first pouch and the third pouch are each disposed at a 90-degree angle with respect to the second pouch, the fourth pouch, the fifth pouch, and the sixth pouch in the core;

the first pouch, the sixth pouch, the third pouch, and the second pouch are arranged on a first surface of the first shell;

a second surface of the first shell is an opposite side of the first shell from the first surface thereof;

the first pouch is configured to unfold 90 degrees from the core to lie along a substantially horizontal plane;

the second pouch is configured to unfold 180 degrees from the core to lie along the substantially horizontal plane; and the third pouch is configured to unfold 90 degrees from the core to lie along the substantially horizontal plane.

9. The modular utility kit of claim 8, wherein the first pouch, the second pouch, the third pouch, and the sixth pouch contact a first surface of the first shell.

10. The modular utility kit of claim 9, wherein a second surface of the first shell is an opposite side of the first shell from the first surface thereof, and the second surface of the first shell is an outer surface thereof detachably surrounding the core.

* * * * *